US006460968B1

(12) United States Patent
Chee et al.

(10) Patent No.: US 6,460,968 B1
(45) Date of Patent: Oct. 8, 2002

(54) WIPER FOR INKJET PRINTERS

(75) Inventors: Swee Guan Chee; Kay Khoon Khoo, both of Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/594,196

(22) Filed: Jun. 14, 2000

(51) Int. Cl.[7] ..... B41J 2/165
(52) U.S. Cl. ..... 347/33
(58) Field of Search ..... 347/33, 24

(56) References Cited

U.S. PATENT DOCUMENTS 5,610,641 A 3/1997 Ikado
5,614,930 A * 3/1997 Osborne et al. ..... 347/33
5,815,176 A * 9/1998 Rotering ..... 347/33
6,155,666 A * 12/2000 Sugimoto et al. ..... 347/24

FOREIGN PATENT DOCUMENTS

| | | | |
|---|---|---|---|
| EP | 446885 | * | 9/1991 |
| EP | 0673772 | | 9/1995 |
| JP | 403019847 | * | 1/1991 |
| JP | 403215043 | * | 9/1991 |

* cited by examiner

*Primary Examiner*—John Barlow
*Assistant Examiner*—Ly T Tran

(57) ABSTRACT

A wiper that does not scratch exit regions of nozzles during wiping process is disclosed. The wiper has a non-recessed wiping region and a recessed wiping region at one end. The recessed wiping region is positioned approximately opposite to columns of nozzles of a printhead during wiping, such that the wiper does not directly contacts the nozzles. The non-recessed regions, however, presses against the printhead to exert desired forces for wiping and maintains a gap between the printhead and the recessed wiping region.

7 Claims, 7 Drawing Sheets

WIPER FOR INKJET PRINTERS

BACKGROUND OF THE INVENTION

This invention relates generally to inkjet printers, and particularly, to a method and structure for wiping the printhead.

Inkjet printers use pens that shoot drops of ink onto media such as paper sheets. Each pen has a printhead formed with very small nozzles through which the ink drops are fired. The printhead is mounted on a bi-directionally movable carriage, such carriage being configured to reciprocate back and forth across the paper as printing occurs. The structure and operation of such printheads and carriages are well known to those skilled in the art.

In order to keep printheads in proper printing condition, most inkjet printers use a mechanism at some point along the printhead's path to periodically service the printhead during normal use. Such mechanism generally includes a wiper that sweeps across the printhead to clear its printing surface of contaminants such as dried or drying ink.

A conventional wiper includes a chassis-mounted base and an elongate blade. The blade extends from the base to a tip that engages the printhead's printing surface when the printhead passes across it. The blade is typically planar and is of a size determined by the physical characteristics of the printer in which it is used. The blade's thickness is determined to produce a wiper that exerts a desired force on the printhead when the wiper is engaged with the printhead. Typically, the blade is made of flexible material.

FIGS. 1 and 2 illustrate a conventional wiper wiping a printhead. In FIG. 1, a cartridge 10 has an ink reservoir 12 and a printhead 14. The printhead 14 has a metal or plastic orifice plate 16 with two parallel columns of offset nozzles 18 formed on the plate 16. The orifice plate 16 is fixed to the surface of a semiconductor substrate (not shown).

FIG. 2 is taken along line A—A in FIG. 1 to illustrate an elastomeric wiper 20 wiping the printhead 14. As indicated, the wiper 20 is in the form of an elongate blade which includes a wiping region 22. The wiper 20, in particular the wiping region 22, presses against the nozzle plate 16 of the associated print cartridge to wipe off ink drops. During the wiping, however, the edge 22*a* of the wiping region 22 scratches exit regions 24 of the nozzles 18 as illustrated. Such scratches cause damages to the nozzles such that the exist regions 24 of the nozzles 18 are deformed. These damages affect the size, trajectory, and speed of ink drop ejection during printing, and in turn affect the inkjet printhead's performance.

Accordingly, there is a need for a wiper that does not damages the nozzles' exist regions.

SUMMARY OF THE INVENTION

In a preferred embodiment, the invention provides a wiper that does not scratch exit regions of nozzles during wiping process.

In a preferred embodiment according to the invention, a wiper for inkjet printhead has a slightly recessed wiping region at a first end. The recessed wiping region is positioned approximately opposite to columns of nozzles of the printhead during wiping and indirectly contacts the nozzles. Thus, the wiper does not directly contact the nozzles.

According to a further aspect of the invention, the wiper also has a non-recessed wiping region at the first end and adjacent to the recessed wiping region. The non-recessed wiping region presses against the printhead to exert desired forces for wiping. Preferably, the non-recessed wiping region maintains a gap between the printhead and the recessed wiping region.

DETAILED DESCRIPTION OF THE INVENTION

Figure 1:
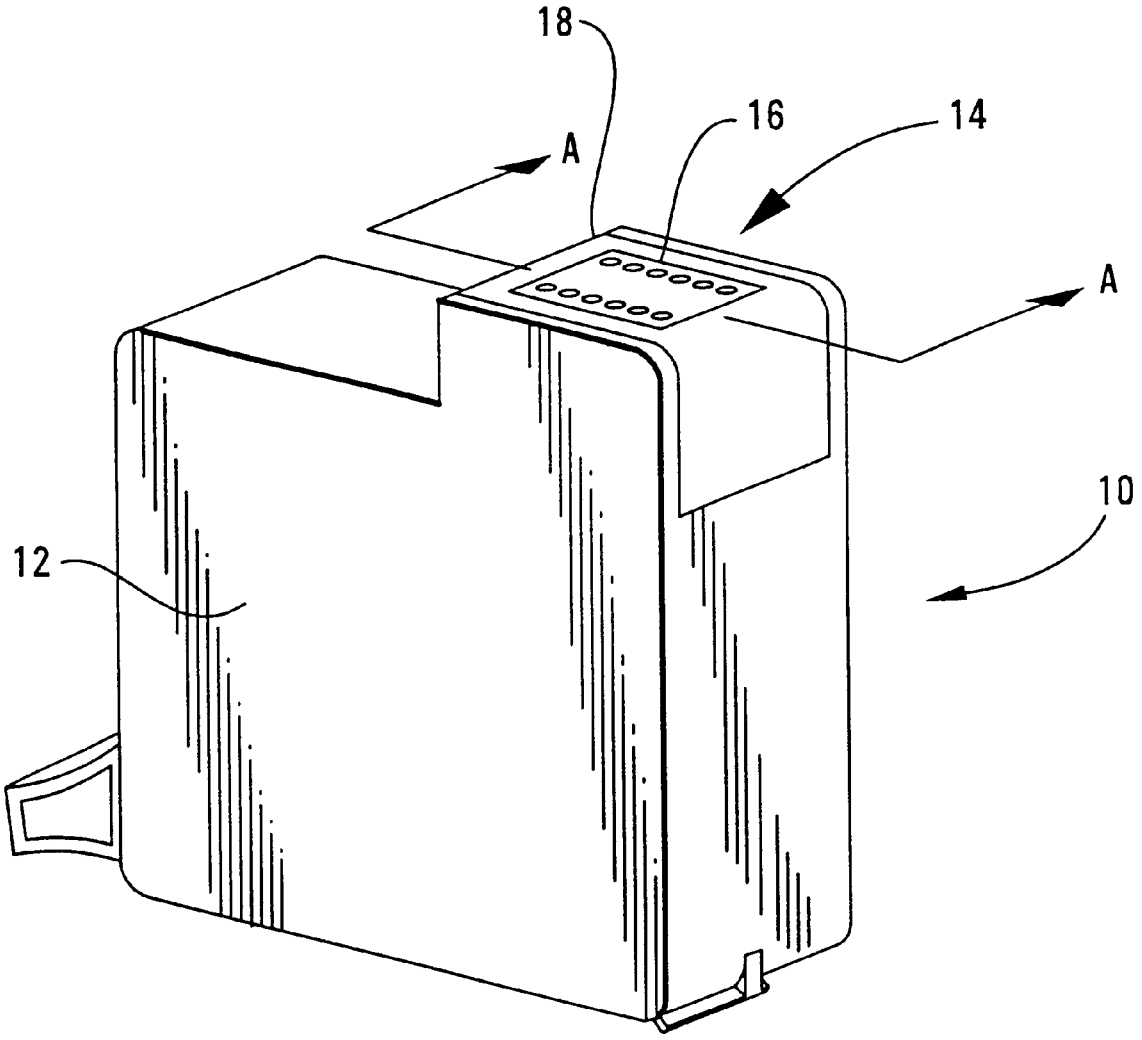
FIG. 1 is a perspective view of an inkjet print cartridge which may use the present invention.
Figure 2:
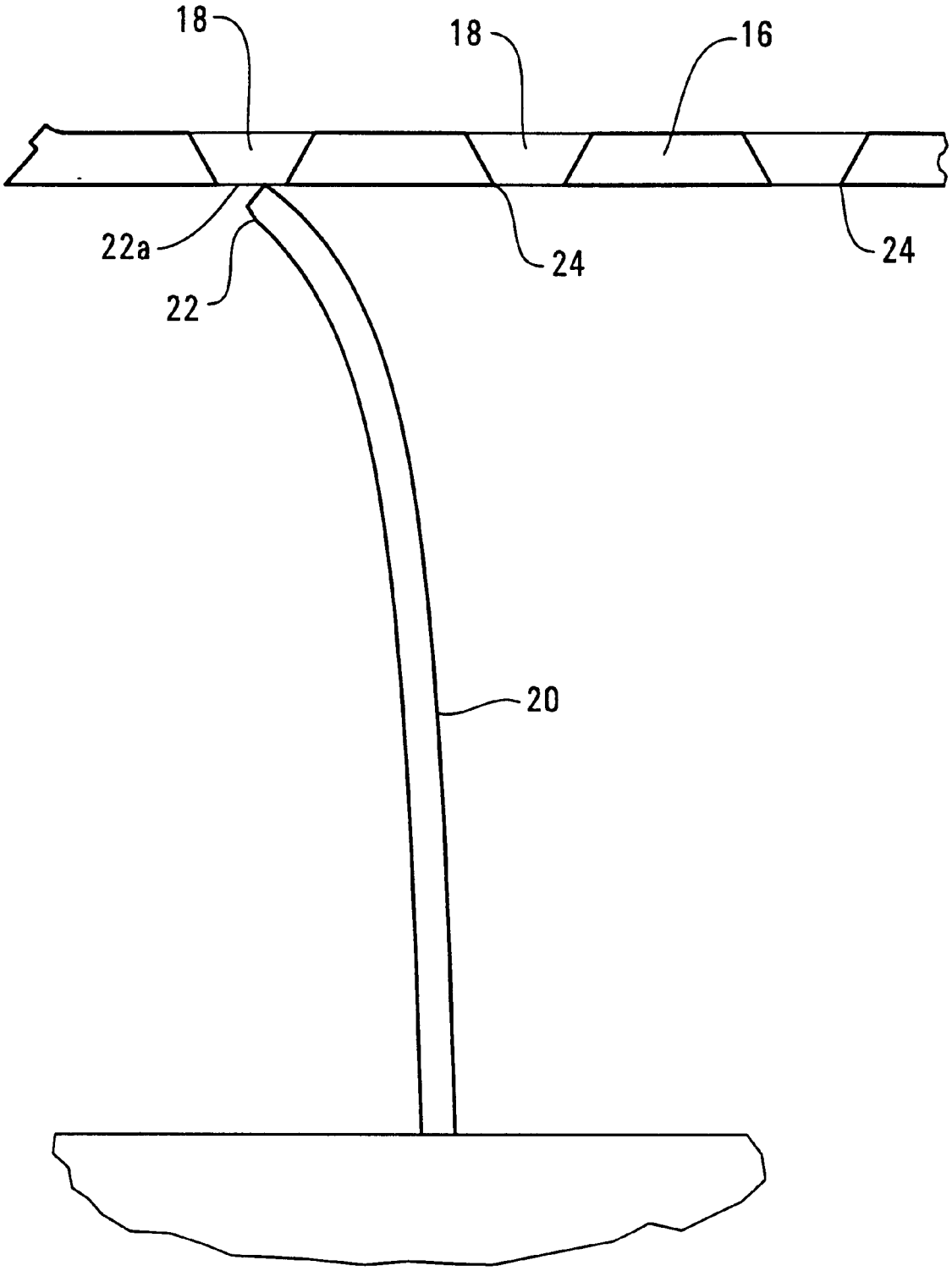
FIG. 2 illustrates a side view in cross-section along line A—A of FIG. 1 when a conventional wiper is moved across the print cartridge of FIG. 1.
Figure 3A:
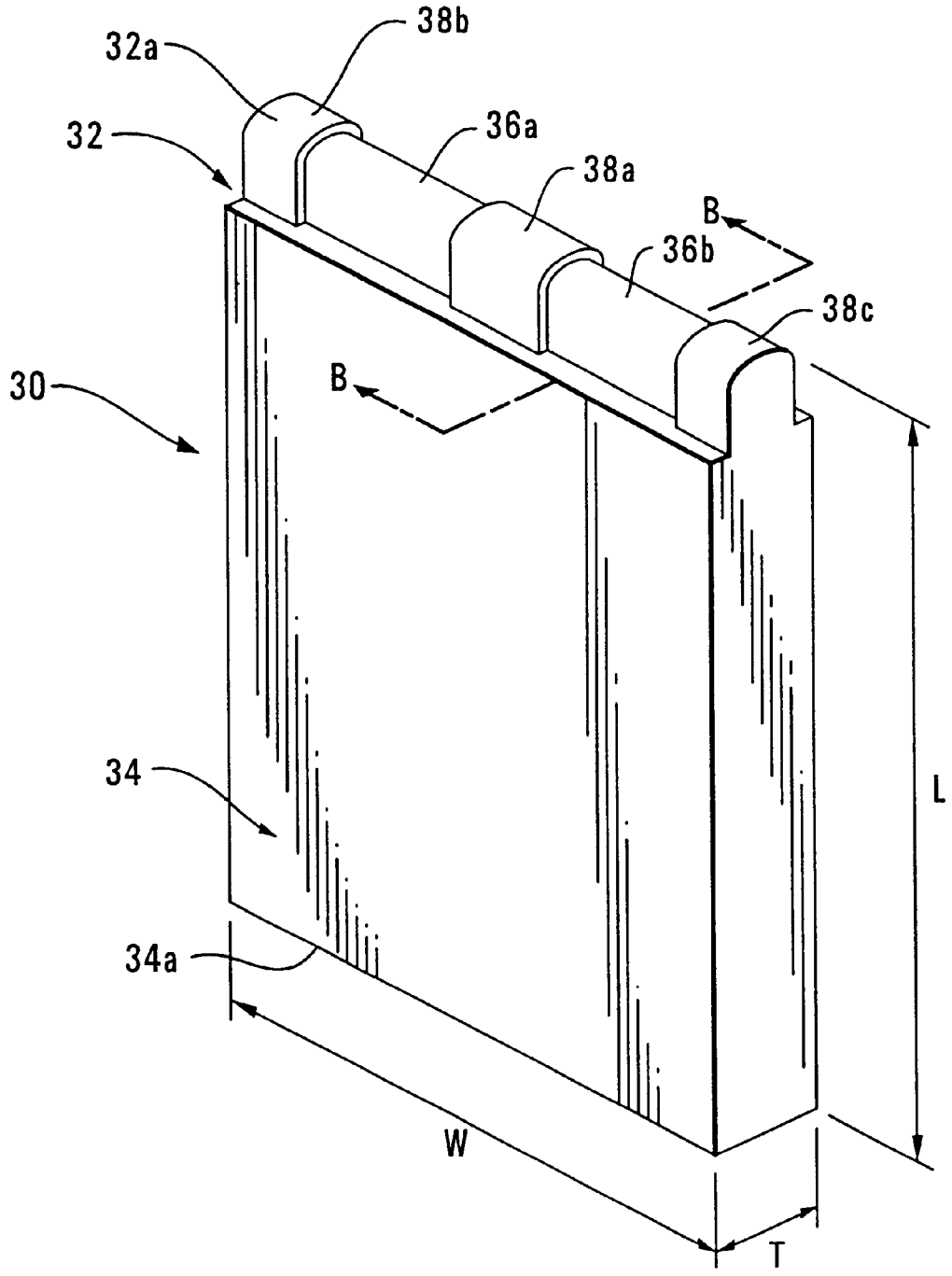
FIG. 3A is a perspective view of a wiper structure according to the invention.

A preferred embodiment of a wiper 30 for an inkjet printer according to the invention is shown in FIG. 3A. Typically, the wiper is made of flexible material, that is, the wiper is elastomeric. As indicated, the wiper 30 is in the form of an elongate blade having a wiping region 32. The wiping region 32 terminates in a first end 32*a*. The blade also has a securement region 34 adjacent to the blade's second end 34*a*. The securement region is configured to provide for securement of the wiper 30 to a chassis of the printer or on a movable sled (not shown).

The wiping region 32 according to the present invention has two slightly recessed wiping regions 36*a* and 36*b* separated by a non-recessed region 38*a* at the first end. At two sides of the wiping region 32, there are also two non-recessed regions 38*b* and 38*c* adjacent to the recessed wiping regions 36*a* and 36*b*, respectively.

Figure 4:
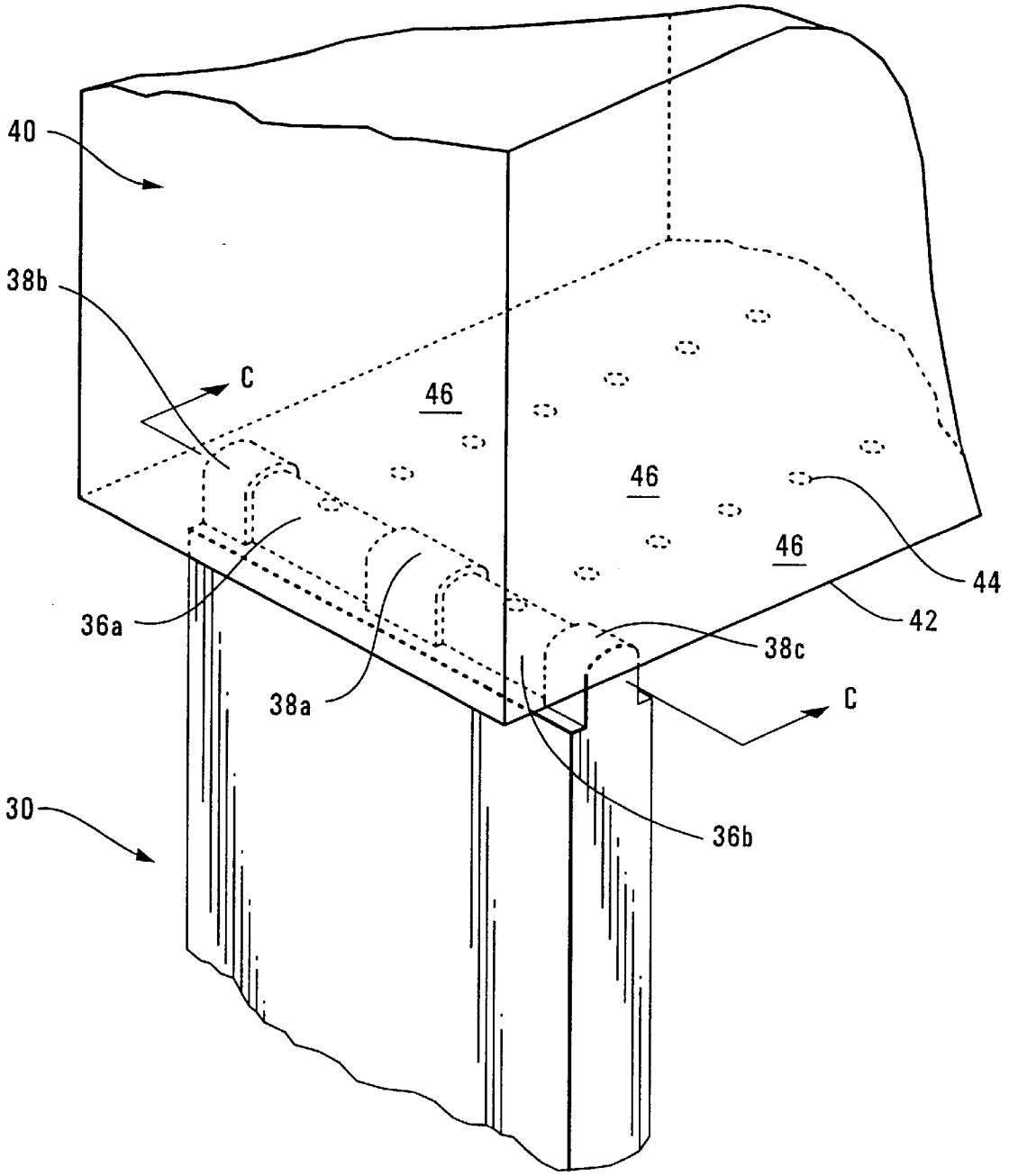
FIG. 4 is a perspective view illustrating the wiper of FIG. 3A wiping the print cartridge of FIG. 1.

FIG. 4 illustrates the wiper 30 wiping a printhead 40 of the printer. The printhead 40 has an orifice plate 42 having two columns of nozzles 44 through which ink drops 48 are ejected onto a media sheet during printing. As illustrated, the recessed wiping regions 36*a* and 36*b* are positioned approximately opposite to the two columns of nozzles respectively during wiping, such that the recessed wiping regions 36*a* and 36*b* wipe contaminants from areas around the nozzles 44.

Figure 5:
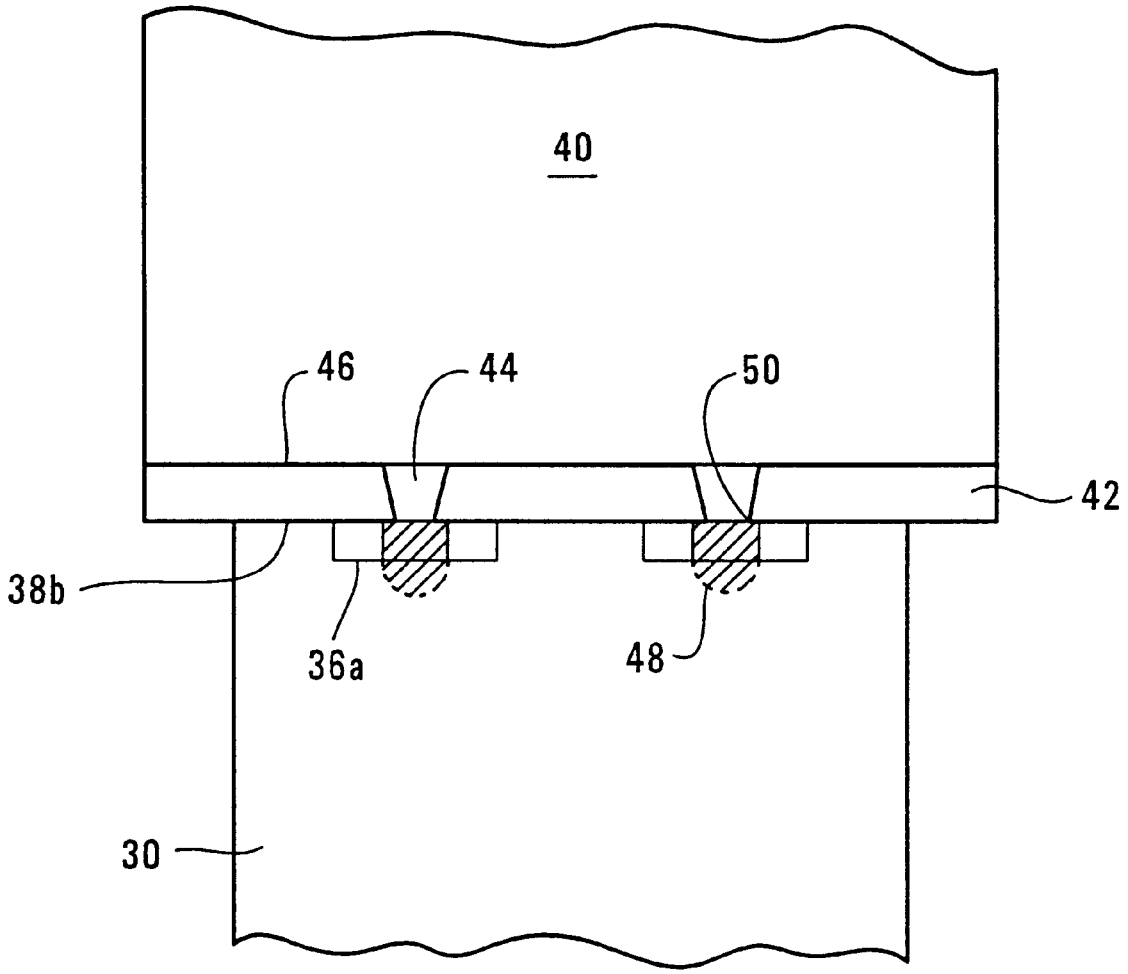
FIG. 5 is a side view in cross-section along line C—C of FIG. 4 when the wiper is moving across the print cartridge.

The orifice plate 42 also has non-nozzle areas 46. As shown in FIG. 5, during wiping, the non-recessed regions 38*a*, 38*b* and 38*c*, of the wiper 30 press against the non-nozzle areas 46 to exert desired forces for wiping. Moreover, the non-recessed regions 38*a*, 38*b* and 38*c*, of the wiper 30 maintain a gap between the orifice plate 42 and the recessed regions 36*a* and 36*b*, regardless of up-and-down movements of the printhead 40.

The recessed wiping regions 36*a* and 36*b* do not contact the nozzles 44 during wiping. Rather, the recessed wiping regions 36*a* and 36*b* hit the ink drops 48 at a place that is slightly distanced away from exit regions 50 of the nozzles 44. Therefore, the invented wiper 30 does not directly contact the exit regions 50 of the nozzles 44. Consequently, the exit regions 50 are not prone to scratches caused by the conventional wiper 20. Moreover, the wiping mechanism is designed such that the contact between the recessed wiping regions and the ink drops 48 provides sufficient force to wick away the ink drops 48.

Figure 3B:
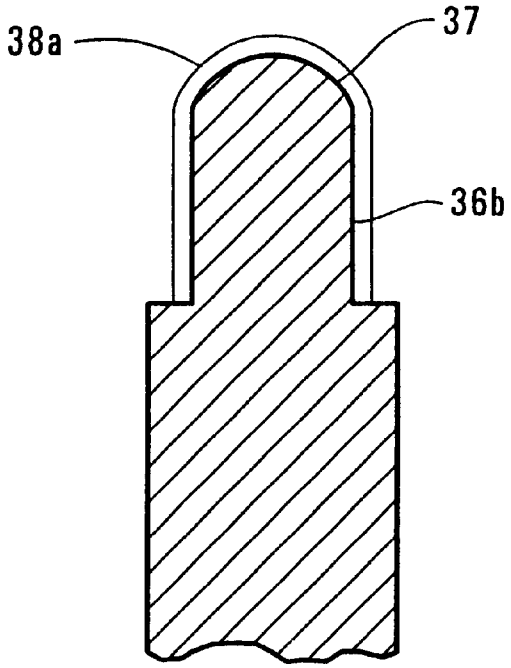
FIG. 3B is a side view in cross-section along line B—B of FIG. 3A.
Figure 3C:
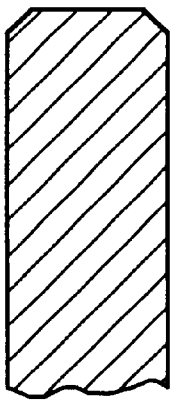
FIGS. 3C, 3D and 3E illustrate some examples of the profiles of wiping regions.
Figure 3D:
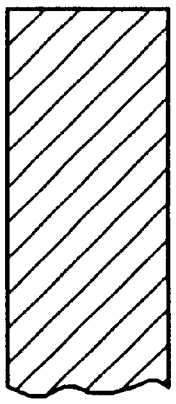
Figure 3E:
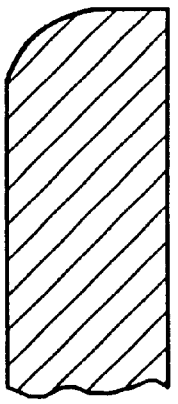

FIG. 3B is a cross-sectional view along line B—B, illustrating the profile of the recessed wiping region 36*b* and non-recessed region 38*a*. In the preferred embodiment, both the recessed wiping regions and the non-recessed regions have worn edges 37. It is understood that the recessed wiping regions and/or the non-recessed regions can have different profiles, as illustrated in FIGS. 3C, 3D and 3E.

Typically, in a preferred embodiment, the length of the wiper blade 30 is approximately 7.6 millimeters (accommodating printhead interference), and the width is approximately 8.0 millimeters (ensuring that the wiper will wipe the entire printhead). In the preferred embodiment, the wiper blade has a thickness of approximately 1.2 millimeters at the second end 34*a,* a thickness of approximately 1.0 millimeter for the non-recessed regions 38*a,* 38*b* and 38*c,* and a thickness of approximately 0.9 millimeter for the recessed wiping regions 36*a* and 36*b*. In another embodiment, however, the wiper blade has a uniform thickness of 1.2 millimeters.

In the preferred embodiment, the difference in length between the recessed wiping regions and the non-recessed regions is not more than 0.07 millimeter, e.g., 0.01 millimeter or 0.02 millimeter. Thus, the gap between the printhead 40 and the recessed wiping regions 36*a* and 36*b* is also less than 0.07 millimeter.

INDUSTRIAL APPLICABILITY

Figure 6:
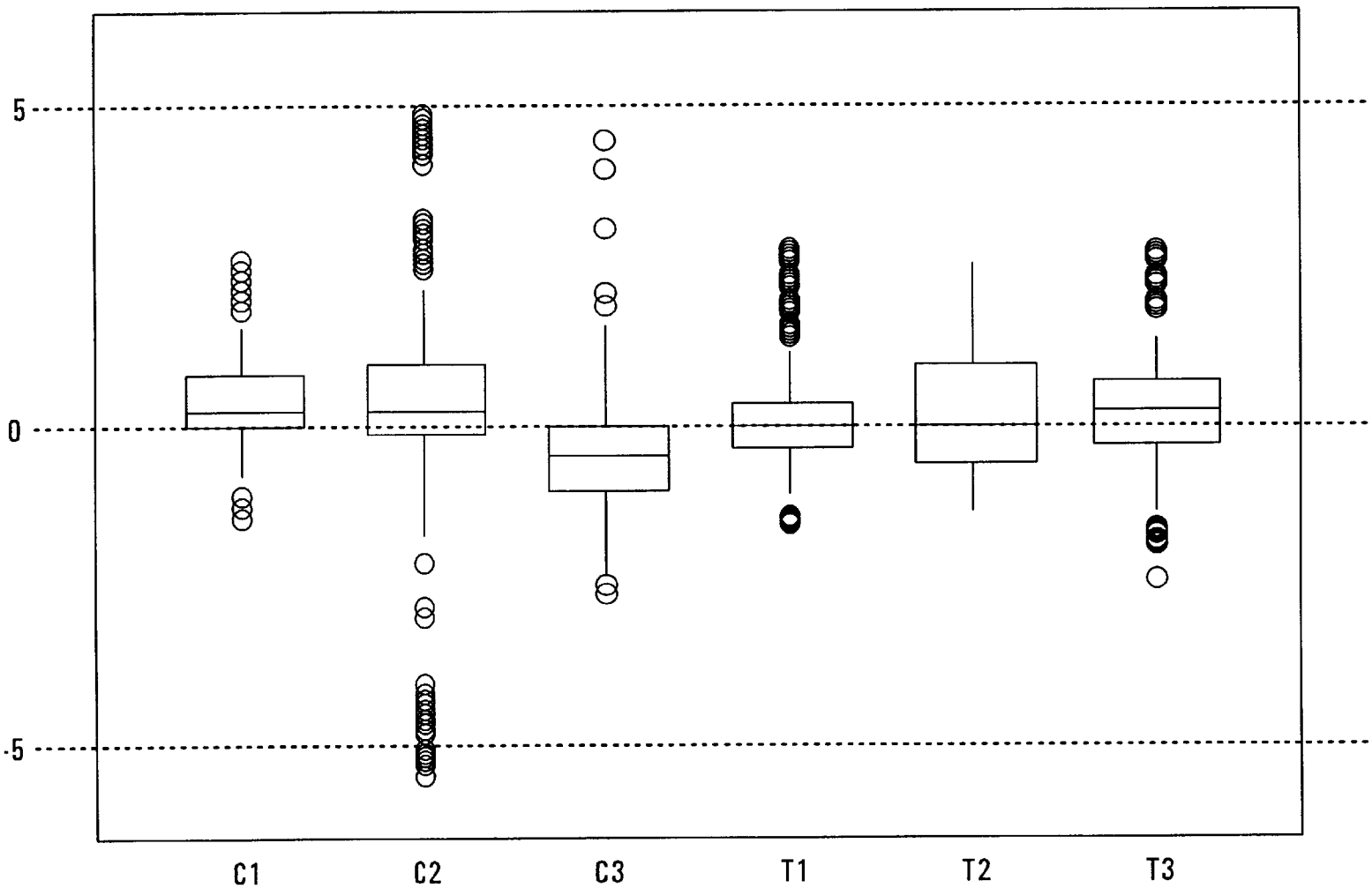
FIG. 6 shows relative-vertical-trajectory-error test results of samples of conventional wipers and current invention.

The invention provides a convenient way of avoiding scratches on exit regions of nozzles. Relative vertical trajectory error of ink drops ejected is studied. As illustrated in FIG. 6, three samples of conventional wipers, C1, C2 and C3, and three samples of current invention, T1, T2, and T3, are tested. Six identical printheads have been wiped for 1000 times by these six wipers respectively before the relative vertical trajectory error of ink drops is tested. As shown in FIG. 6, samples T1, T2 and T3 of the current invention have better drop trajectory performance. Particularly, the mean relative vertical trajectories of samples T1, T2, and T3 are closer to zero than those of sample C1, C2, and C3, and the spreads of the relative vertical trajectories of samples T1, T2, and T3 are less than those of samples C1, C2, and C3.

What is claimed is:

1. A wiper for wiping an inkjet printhead, the printhead having nozzles through which ink drops are fired, comprising:

a recessed wiping region at a first end of the wiper for wiping off ink drops, wherein the recessed wiping region indirectly contacts the nozzles during wiping; and a non-recessed wiping region at the first end and adjacent to the recessed wiping region, wherein the non-recessed wiping region presses against the printhead to exert desired forces for wiping;

wherein the recessed wiping region and the non-recessed wiping region are positioned such that as the wiper wipes the printhead, at least part of the recessed wiping region wipes over the nozzles, while the non-recessed wiping region wipes around the nozzles.

2. The wiper of claim 1, wherein the printhead further has areas having no nozzles thereon and the non-recessed region contacts said areas during wiping.

3. The wiper of claim 1, wherein the non-recessed wiping region maintains a gap between the printhead and the recessed wiping region.

4. The wiper of claim 3, wherein the gap between the printhead (40) and the recessed wiping region (36*a,* 36*b*) is not more than 0.07 millimeter.

5. The wiper of claim 1, wherein the recessed wiping region (36*a,* 36*b*) contacts the ink drops (48) at a place slightly distanced away from the printhead (40) such that the recessed wiping region (36*a,* 36*b*) does not contact the nozzles (44) directly when it (36*a,* 36*b*) wicks away the ink drops (48).

6. The wiper of claim 1, wherein the wiper (30) is elastomeric.

7. The wiper of claim 1, wherein the wiper (30) is in a form of an elongate blade.

* * * * *